United States Patent [19]

Petersen et al.

[11] 3,958,619

[45] May 25, 1976

[54] METHOD FOR THE SEPARATION OF CASTINGS FROM CASTING MOULDS OR SIMILAR MATERIAL AND A FOUNDRY MACHINE FOR CARRYING OUT THIS METHOD

[75] Inventors: Carl Herbert Petersen, Vaerlose; Marius Günnergaard, Lyngby, both of Denmark

[73] Assignee: Dansk Industri Syndikat A/S, Herlev, Denmark

[22] Filed: Jan. 31, 1974

[21] Appl. No.: 438,366

[30] Foreign Application Priority Data

Feb. 6, 1973 Denmark ..... 631/73

[52] U.S. Cl. ..... 164/131; 164/344; 164/404

[51] Int. Cl.[2] ..... B22D 17/22; B22D 29/00

[58] Field of Search ..... 164/131, 344, 345, 348, 164/401, 404, 405, 5

[56] References Cited

UNITED STATES PATENTS

| | | | |
|---|---|---|---|
| 1,190,434 | 7/1916 | Loughran | 164/404 |
| 1,475,648 | 11/1923 | Nelson | 164/404 |
| 2,020,131 | 11/1935 | Behnke | 164/404 X |
| 2,766,496 | 10/1956 | Ward | 164/5 |
| 3,175,686 | 3/1965 | Rieth | 164/5 X |
| 3,273,210 | 9/1966 | Taccone | 164/344 X |
| 3,604,493 | 9/1971 | Schumacher | 164/5 |
| 3,627,020 | 12/1971 | Taccone | 164/344 |

*Primary Examiner*—Francis S. Husar
*Assistant Examiner*—John S. Brown
*Attorney, Agent, or Firm*—Imirie, Smiley & Linn

[57] ABSTRACT

For the purpose of separating castings from the sand or similar material forming a string of moulds, each of the castings proper together with a lump of heat damaged mould material totally surrounding the castings is separated from the mould string. After having been subjected to an appropriate degree of cooling, the castings are separated from the lump material which, after sufficient regeneration, may be re-used together with the non-damaged material of the moulds.

6 Claims, 4 Drawing Figures

METHOD FOR THE SEPARATION OF CASTINGS FROM CASTING MOULDS OR SIMILAR MATERIAL AND A FOUNDRY MACHINE FOR CARRYING OUT THIS METHOD

BACKGROUND OF THE INVENTION

In automatic foundry machines for the manufacture of castings in sand moulds it is known to perform the pouring while the casting moulds are carried on a conveyor on which the filled casting moulds are advanced to a knocking-out station provided with a grid. On this grid, the castings are separated from the mould material which drops down through the grid and is returned to the mould production apparatus. The intense heat from the metal poured damages the mould sand which therefore must be regenerated between the successive applications. As a rule, for the purpose of regeneration, a certain percentage of the mould sand is removed on its way from the knocking-out grid to the mould production apparatus and is substituted by unused material, which is mixed thoroughly with the remaining part of the mould sand, possibly with the addition of special components for improving the properties of the mould sand in various respects.

Prior art foundry machines of this type cause a great deal of inconvenience, such as a high noise level and development of dust, heat and smell.

A particular problem arises in connection with casting moulds comprising one or more cores. The binding or bonding agent used in such cores consists increasingly of artificial resins that are thermally destroyed by heat from the poured metal so as to loose their binding effect in order to allow the core material to flow freely out of the cavities when the castings are knocked out of the moulds. When using such cores, the need for regeneration of the mould material is substantially increased because the material may comprise a rather great proportion of core sand devoid of active binder. Accordingly, in the regeneration step an appropriate quantity of new binder must be added and must be carefully admixed into the used mould material, and the regeneration step must also include withdrawal or removal of a portion of used material similar to the portion added as core material.

In the following specification the terms mould sand and mould material should be understood to include the material of any cores incorporated in the moulds.

SUMMARY OF THE INVENTION

Starting from this prior art technique, the invention relates to a method for the separation in two stages of castings from casting moulds of sand or similar material, by which the casting moulds subsequent to the pouring operation are advanced to a knocking-out station. According to the invention, the castings together with a lump of mould material totally enclosing the same are removed from the remaining parts of the casting moulds at an early stage of the cooling thereof, and after further cooling the castings themselves are separated from the mould material forming the lump.

The invention is based on the recognition that the severe heating of the mould material and, consequently, the damaging thereof can be limited to a more or less thick layer of sand which immediately surrounds the casting cavities of the moulds. By the method according to the invention the said layer of sand, i.e. the lump referred to above, is removed from the remaining parts of the casting moulds at a relatively early point during the cooling process so that this process is promoted, and the part of the casting moulds, in which the temperature of the material has not yet reached the limit at which an appreciable damage is caused by heat influence, is effectively prevented from being heated further and therefore only requires a suitable disintegration before being re-used. The quantity of more or less dead-burnt mould sand which in each individual case should be removed together with the castings depends on numerous different factors, such as the casting temperature, the weight and shape of the castings and the composition of the mould material, and may amount to only one fourth or to a still smaller fraction of the total quantity of mould material. Only this rather modest quantity of material need be subjected to a regeneration, e.g. by being partially renewed and by the addition of special components, before being re-used. Consequently, the invention offers the possibility of an essential economy with regard to the initial costs of the equipment used and the costs of operation thereof as well as of a considerable reduction in the inconveniences mentioned above. Further, it becomes possible to control the cooling progress in such a way that the technological properties of the castings are favorably influenced.

The invention furthermore relates to a foundry machine which is intended for carrying out the method explained and which in a manner known per se comprises a conveyor for advancing the casting moulds with the castings to a knocking-out station. According to the invention, the machine is characterized in that the knocking-out station comprises a device for removing the castings and a lump of mould material totally enclosing the same from the remaining parts of the casting moulds, a first treatment zone with means for cooling and crushing these remaining casting mould parts, and a second treatment zone with means for separating the castings from the material forming the lump.

A number of technical advantages of this foundry machine are apparent from the above explanation, but in addition it may be pointed out that the establishment of the two separated treatment zones for the directly re-usable mould material and the heat-damaged material, respectively, makes possible a particularly flexible operation of the total equipment including the automatic mould production apparatus.

The device for removing the castings and the enclosing lump of mould material can be designed in many different ways, but according to the invention it preferably comprises a grap having a number of downwardly directed teeth, placed along the horizontal contour of the lump to be removed and operable to be pressed down into the casting moulds and to subsequently lift the lump and displace it laterally for the purpose of placing it on a cooling conveyor which leads to a castings cleaning device and extends parallel to a cooling conveyor incorporated in the said first treatment zone for the remaining casting mould parts. When the grab teeth are pressed down along the desired separating surface between the lump of heat-damaged material and the remaining parts of the casting moulds, no general breaking of the said parts or of the lump need occur that would trouble the subsequent handling thereof. The grab used may be adjustable or exchangeable according to the nature and size of the castings, so that in each individual case it can be ensured that a suitable quantity of mould material is removed together with the castings.

The invention will now be more fully described with reference to the drawings

DESCRIPTION OF THE PREFERRED EMBODIMENTS

Figure 1:
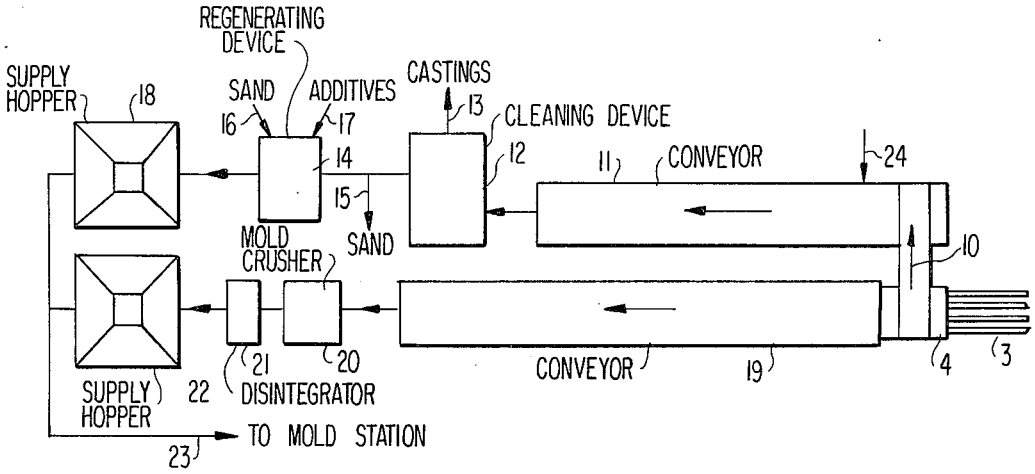
FIG. 1 is a diagrammatical plan view of an embodiment of the foundry machine of the present invention.

The machine or equipment shown in the drawing is designed to be used in connection with a device, not shown, for the successive production of mutually identical mould parts 1 which are placed together so as to form a continuous row or string having one or more casting cavities at each joint 2. After having passed a pouring station, not shown, the string of casting moulds 1 is advanced stepwise on a conveyor 3, for instance a travelling grate conveyor, and arrives after a suitable cooling at a supporting plate 4. In this position, a grab consisting substantially of a plate-shaped carrier 5 and a number of downwardly-directed teeth 6 and 6' is lowered into the casting mould, FIG. 2, so that the teeth enclose the castings and form a separating surface 7 between the more or less deadburnt lump 8 of the moulding material immediately enclosing the castings, and the remaining parts 9 of the casting mould. By an upward movement of the said grab 5, 6 the lump with the castings is raised clear of the remaining casting mould parts 9 and is displaced laterally as indicated by the arrow 10 in FIG. 1 into the position shown in FIG. 3, in which the grab is lowered and opened as shown in FIG. 4 so that the lump is placed on a conveyor 11 which may extend through a cooling tunnel, not shown, for promoting the cooling of the lump 8. In certain cases the addition of cooling water or the provision of a forced air circulation as indicated by the arrow 24 in FIG. 1 may be used to control the cooling process. On the other hand, if a prolongation of the cooling time be desired, the conveyor 11 may extend through an oven for temperature-controlled, delayed cooling. The same effect may be achieved by the supply of a covering material, e.g. waste sand, at the arrow 24 in FIG. 1. By this means a too rapid cooling of sensitive castings is avoided.

Figure 2:
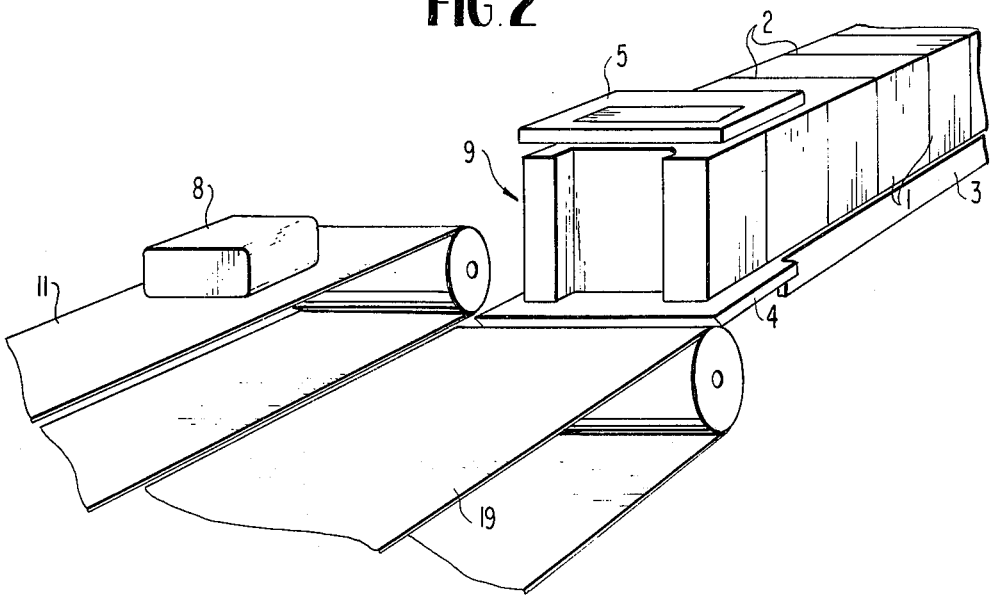
FIGS. 2, 3 and 4 are perspective views of parts of this machine, shown in three different phases during the operation.

The lump 8 is by the conveyor 11 advanced to a castings cleaning device 12, FIG. 1, from which the cleaned castings are removed as indicated by the arrow 13, while the more or less heat-damaged mould sand is conducted to a regenerating device 14. On its way to this device a desired portion of this sand material may be removed, as indicated by the arrow 15, to be substituted by fresh sand which is added to the material in the regenerating device 14 as indicated by the arrow 16. The arrow 17 pointing to the same device is to indicate the addition of desired components, if any, to the regenerated and re-mixed sand before the latter is delivered to a hopper 18.

The remaining mould parts 9 mentioned above are from the plate 4 pushed forwards onto a conveyor 19 where the material is cooled to the degree desired and next delivered through a mould crusher 20 and a disintegrator 21 to a supply hopper 22. From the two supply hoppers 18 and 22 the mould material may, as indicated by the arrow 23, be returned to the mould production device for re-use.

Figure 3:
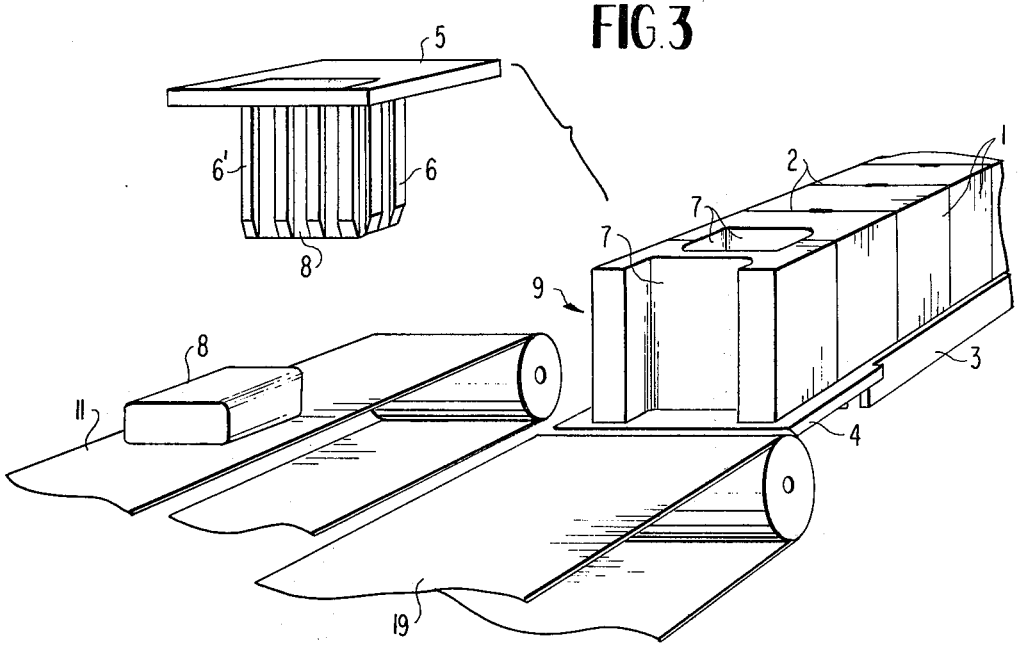
Figure 4:
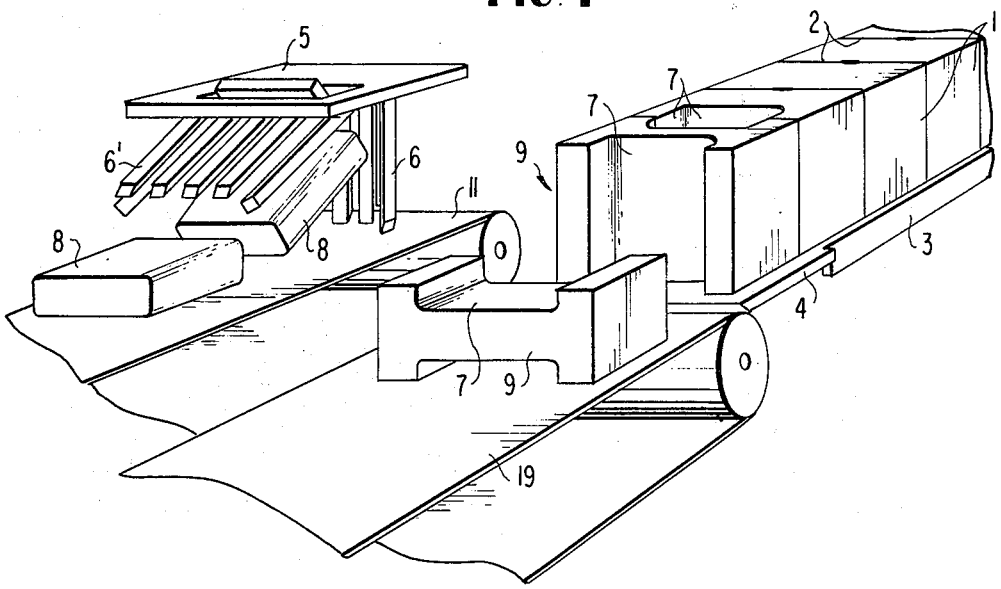

As mentioned above, the removal of the castings together with the enclosing lump of mould material may be performed in other ways than by means of the grab shown in FIGS. 3 and 4 and comprising stationary teeth 6 and pivotal teeth 6'. Thus, for the same purpose it is possible to use for instance a tube for cutting out and removing the lump with the castings. Another possibility consists in removing the castings and the enclosing lump in the downward direction provided that the plate 4 has an aperture suited for this purpose. The conveyor 11 for the castings and the heat-damaged sand may then be arranged underneath the conveyor 19 shown. In addition, the lump with the castings may be removed or pushed out through one of the side surfaces of the mould string or possibly through its freely exposed end surface. It will likewise be possible to provide a lump cutting-out tool under the row or string of casting moulds for the removal of the lump upwardly or downwardly.

We claim:

1. A method for two stage separation of castings from breakable casting moulds, comprising the steps of:

cutting out and removing the castings together with an encasing lump of substantially exclusively heat damaged mould material from the remaining, surrounding parts of each casting mould undamaged by heat; and then separately removing the mould material forming said encasing lump from said casting.

2. The method of claim 1 further including the steps of:

subjecting the mould material forming said remaining parts of the casting mould to a first treatment;

subjecting the mould material forming said encasing lump to a second treatment; and combining said mould material subjected to said first treatment with said mould material subjected to said second treatment for reuse in the formation of additional casting moulds.

3. The method of claim 2 wherein said first treatment comprises crushing and disintegrating said mould material forming said remaining parts; and wherein said second treatment comprises reconstituting and regenerating said mould material forming said encasing lump to compensate for losses and damage caused by the heat of the casting.

4. The method of claim 1 wherein said cut out casting and encasing lump of mould material is subjected to controlled cooling.

5. The method of claim 1 wherein said encasing lump cut from said casting mould includes substantially all of the mould material damaged by the heat of casting.

6. The method of claim 5 wherein said encasing lump cut from said casting mould excludes substantially all of the mould material undamaged by the heat of casting.

* * * * *